US005641292A

United States Patent [19]

Fann

[11] Patent Number: 5,641,292

[45] Date of Patent: Jun. 24, 1997

[54] DUAL-USE ELECTRIC PLUG

[76] Inventor: Jenn-Wang Fann, No. 59, Tsao-Luo, Bao-Jang Village, Guan-In Hsiang, Taur-Yaun Hsien, Taiwan

[21] Appl. No.: 529,066

[22] Filed: Sep. 15, 1995

[51] Int. Cl.[6] ..... H01R 13/652

[52] U.S. Cl. ..... 439/103

[58] Field of Search ..... 439/103, 104, 439/171–174

[56] References Cited

U.S. PATENT DOCUMENTS

| | | | |
|---|---|---|---|
| 4,015,888 | 4/1977 | Draper et al. | 439/103 |
| 4,078,848 | 3/1978 | Blairsdale | 439/103 |
| 4,954,091 | 9/1990 | Marble et al. | 439/103 |

*Primary Examiner*—Gary F. Paumen
*Attorney, Agent, or Firm*—Bacon & Thomas

[57] ABSTRACT

A dual-use electric plug including a base having vertical receiving chamber and a horizontal side hole, two blades fixedly and perpendicularly fastened to the front side of base for connection to the black wire and the white wire, a grounding prong supported on a spring inside the vertical receiving chamber and moved between the working position outside the vertical receiving chamber for connection to the grounding wire, and the non-working position inside the vertical receiving chamber, and a spring-supported press bar to hold the grounding prong in the working position, wherein the grounding prong can be moved back inside the vertical receiving chamber and retained in the non-working position by depressing the press bar and then releasing it.

4 Claims, 6 Drawing Sheets

DUAL-USE ELECTRIC PLUG

BACKGROUND OF THE INVENTION

The present invention relates to electric plugs, and relates more particularly to a dual-use electric plug which has a movable grounding prong can be alternatively set between the working position and the non-working position.

Regular electric sockets can be commonly divided into two groups, namely, the two-pole electric sockets, and the three-pole electric sockets. An electric plug for two-pole electric socket has two blades for connection to the black wire and the white wire respectively. An electric plug for three-pole electric socket has two blades for connection to the black wire and the white wire, and a grounding prong for connection to the grounding wire. Because an electric plug for three-pole electric socket has a grounding prong, it cannot be coupled to a two-pole electric socket. If to connect an electric plug for three-pole electric socket to a two-pole electric socket, an adapter shall be used. As illustrated in FIG. 1, the electric plug, referenced by 10, has two blades 11 and 12, and a grounding prong 13. The adapter 14 has two blades 15 and 16 at the front side for connection to the black wire and the white wire, and three plug holes (not shown) at the back side for receiving the blades 11 and 12 and grounding prong 13 of the electric plug 10. When the adapter 14 is attached to the electric plug 10, the electric plug 10 can then be connected to a two-pole electric socket. However, if the adapter 14 is not available, the electric plug 10 cannot be used for connection to a two-pole electric socket.

SUMMARY OF THE INVENTION

The present invention has been accomplished to provide a dual-use electric plug which is suitable for use with a two-pole electric socket as well as a three-pole electric socket. According to one aspect of the present invention, the dual-use electric plug comprises a base having vertical receiving chamber and a horizontal side hole, two blades fixedly and perpendicularly fastened to the front side of base for connection to the black wire and the white wire, a grounding prong supported on a spring inside the vertical receiving chamber and moved between the working position outside the vertical receiving chamber for connection to the grounding wire, and the non-working position inside the vertical receiving chamber, and a spring-supported press bar to hold the grounding prong in the working position, wherein the grounding prong can be moved back inside the vertical receiving chamber and retained in the non-working position by depressing the press bar and then releasing it. According to another aspect of the present invention, the dual-use electric plug further comprises a bottom cap covered on a bottom opening on the hollow chamber, the bottom cap having an upright rod, which holds one end of the first spring member.

DETAILED DESCRIPTION OF THE PREFERRED EMBODIMENT

Figure 1:
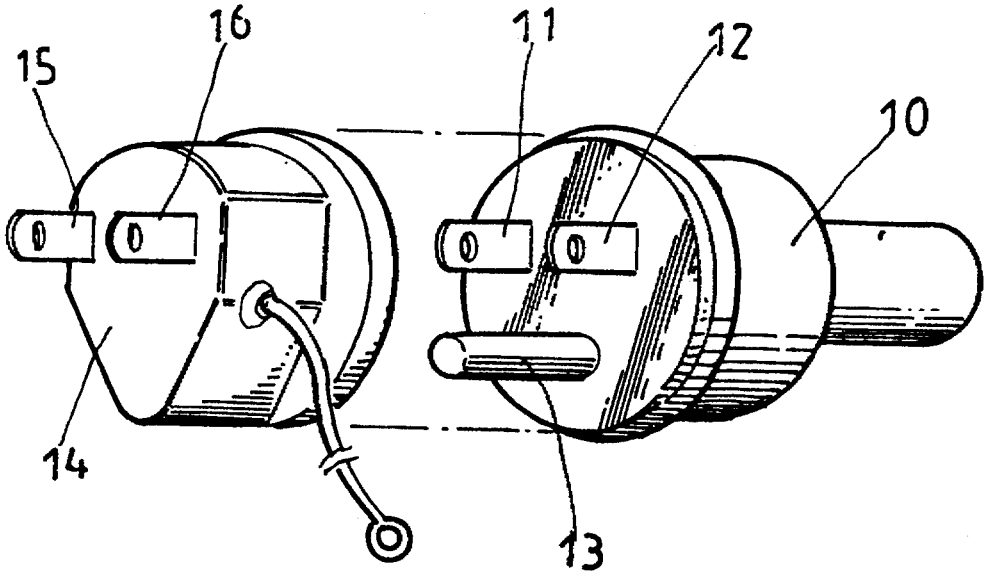
PRIOR ART FIG. 1
FIG. 1 shows an electric plug for three-pole electric socket and an adapter according to the prior art.
Figure 2:
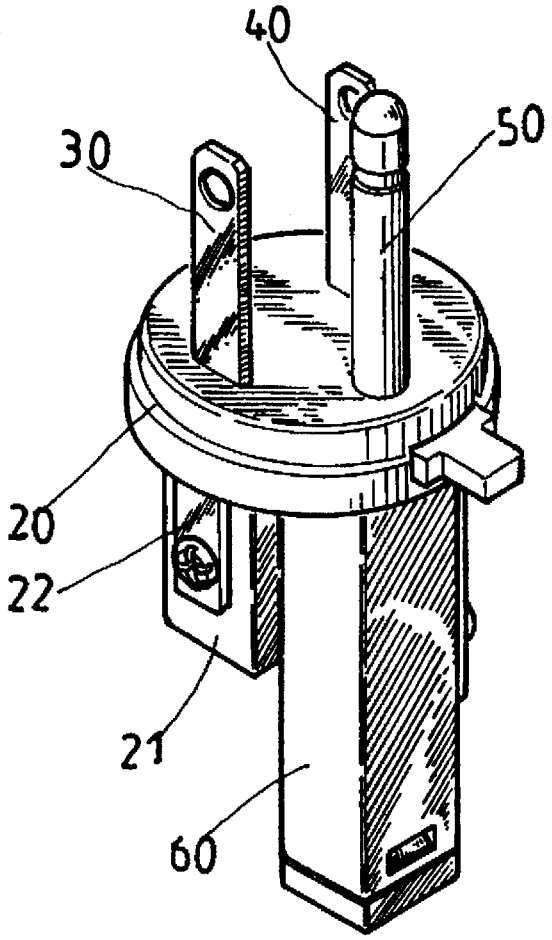
FIG. 2 is an elevational view of a dual-use electric plug according to the present invention.

Referring to FIG. 2, the dual-use electric plug in accordance with the present invention is generally comprised of a base 20, a projecting block 21 perpendicularly extended from the back side of the base 20, two terminals 22 fixedly secured to the projecting block 21 at two opposite sides, two blades 30 and 40 perpendicularly fastened to the front side of the base 20 and respectively connected to the base 20 for connection to the black (hot) wire and the white (neutral) wire, a hollow block 60 perpendicularly extended from the back side of the base 20, and a grounding prong 50 moved in and out of the hollow block 60 through a hole (not shown) on the base 20.

Figure 3:
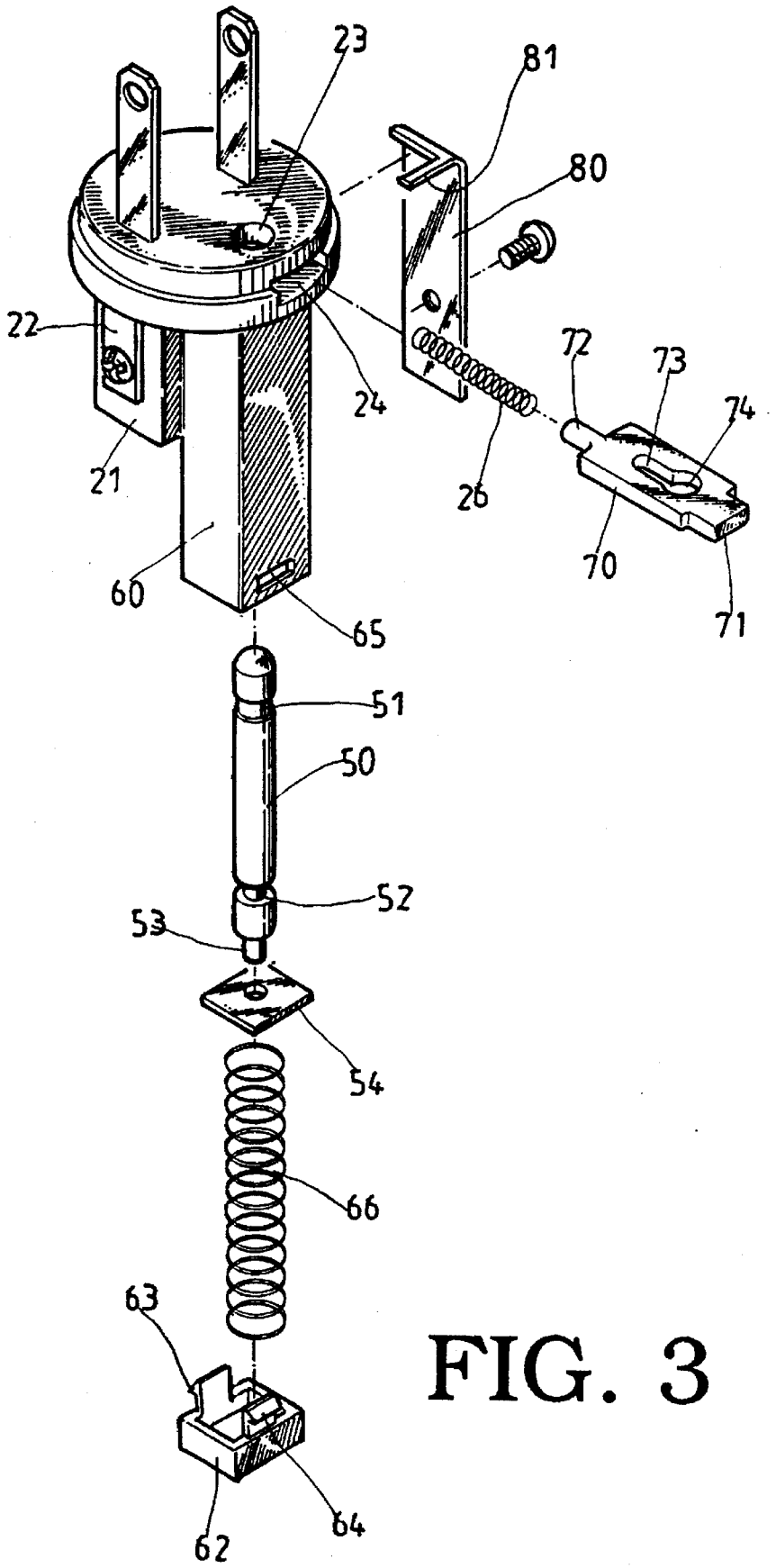
FIG. 3 is an exploded view of the dual-use electric plug shown in FIG. 2.
Figure 5:
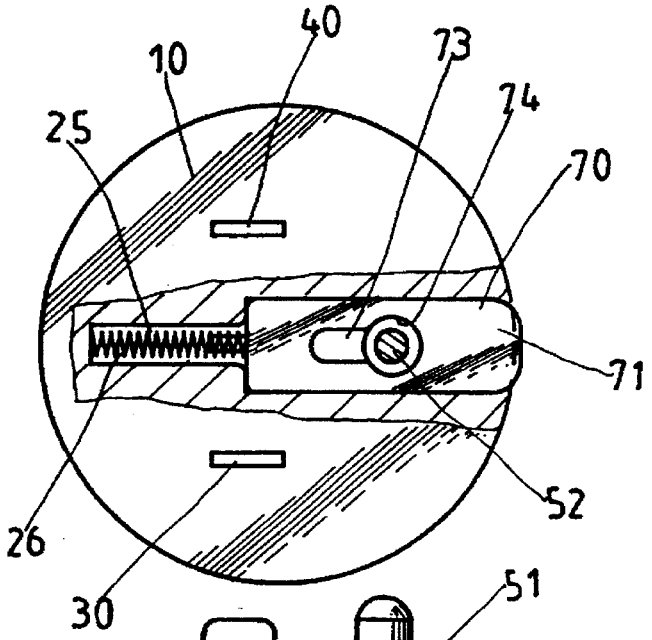
FIG. 5 is a top view of FIG. 4.
Figure 4:
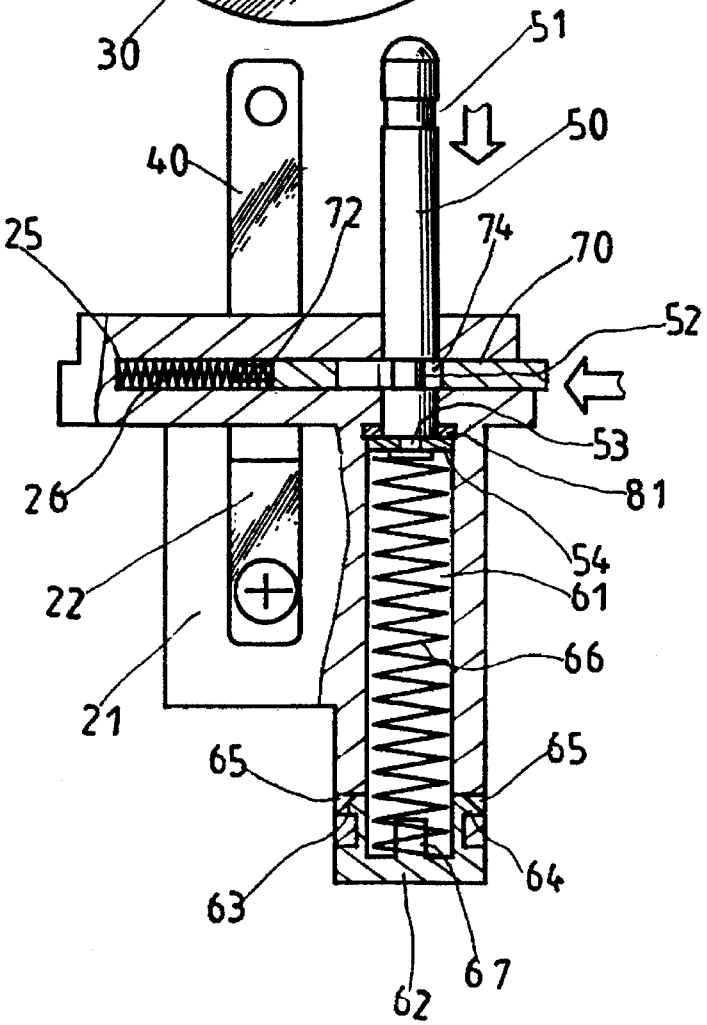
FIG. 4 is a side view in section of FIG. 2, showing the press bar depressed.

Referring to FIGS. 3 and 4, the hollow block 60 defines a receiving chamber 61 for receiving the grounding prong 50. The bottom end of the hollow block 60 is covered by a bottom cap 62. The bottom cap 62 has two hooks 63 and 64 respectively fastened to two opposite side holes 65 near the bottom end of the hollow block 60. A spring 66 is mounted inside the receiving chamber 61. In order to keep the spring 66 in place, an upright rod 67 is made on the bottom cap 62 (see FIG. 4) for holding the bottom end of the spring 66. The grounding prong 50 is made of cylindrical shape, having a first neck 51 and a second neck 52 near two opposite ends, and a bottom tip 53 inserted through a pressure plate 54 and connected to the spring 66 at an opposite end remote from the bottom cap 62. The base 20 has a vertical through hole 23 in communication with the receiving chamber 61 of the hollow block 60 for passing the grounding prong 50, and a horizontal side hole 24 intersecting the vertical through hole 23. The width of the rear end 25 of the horizontal side hole 24 is relatively smaller (see FIG. 5). A coiled spring 26 is longitudinally mounted within the rear end 25 of the horizontal side hole 24. A press bar 70 is inserted into the horizontal side hole 24, having a finger strip 71 at one end extended out of the base 20 for pressing by hand, a projecting rod 72 at an opposite end inserted into one end of the coiled spring 26, and a keyhole in the middle for passing the grounding prong 50. The keyhole is comprised of an oblong hole 73 and a rounded hole 74 at one end of the oblong hole 73. The diameter of the rounded hole 74 is bigger than the width of the oblong hole 73. A grounding contact metal plate 80 is mounted on the outside of the hollow block 60, having a top bent 81 inserted into a horizontal hole (not shown) on the base 20 into the receiving chamber 61 to make contact with the grounding prong 50 (see FIG. 4).

Referring to FIGS. 2 and 4 again, when the dual-use plug is assembled, the press bar 70 is forced outwards by the coiled spring 26, causing one end of the oblong hole 73 to engage the second neck 52 of the grounding prong 50, therefore the grounding prong 50 is stopped at the working position and extended out of the base 20 for connection to the grounding terminal of a three-pole electric socket.

Figure 7:
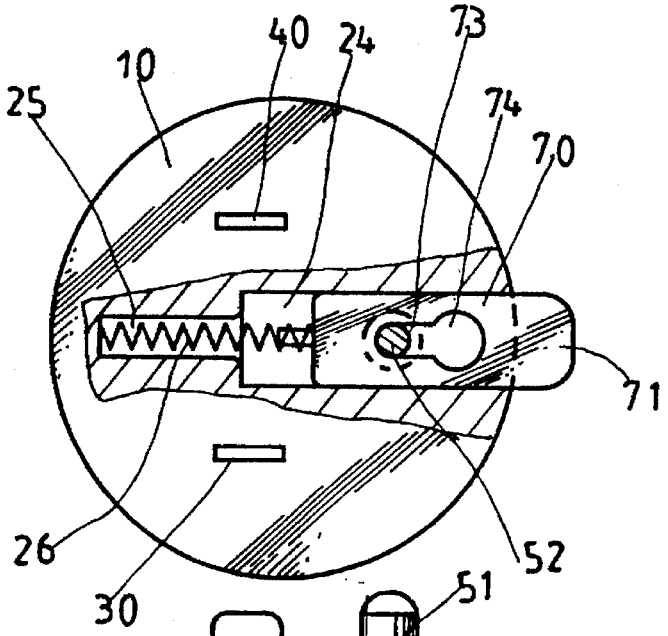
FIG. 7 is top view of FIG. 6.
Figure 6:
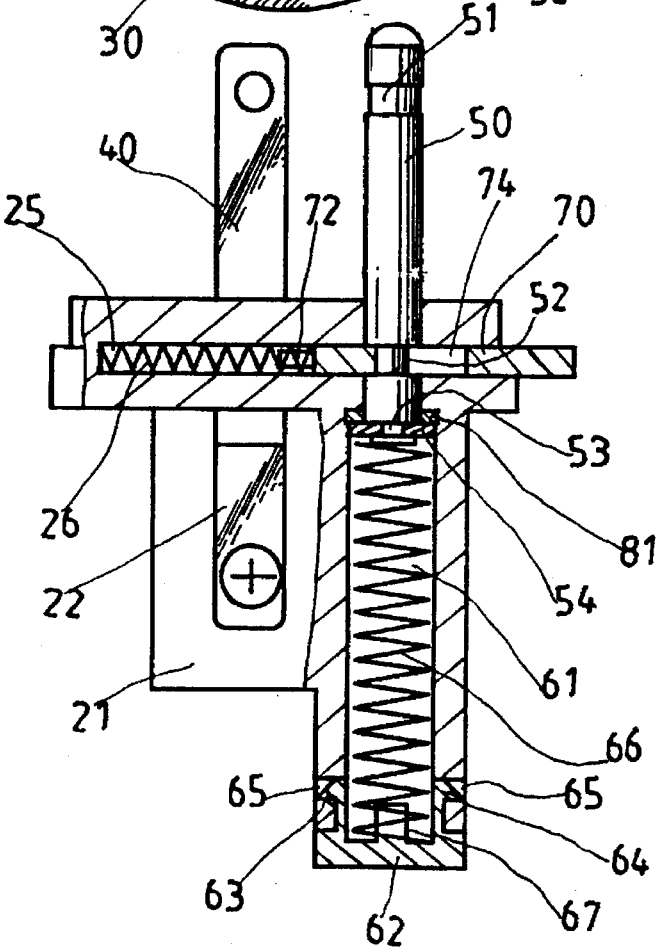
FIG. 6 is similar to FIG. 4 but showing the press bar released and the grounding prong retained in the working position.

Referring to FIGS. 6 and 7, when the press bar 70 is depressed to compress the coiled spring 26, the oblong hole 73 is moved away from the grounding prong 50, and the rounded hole 74 and the grounding prong 50 coincide, therefore the grounding prong 50 can be forced backwards into the inside of the receiving chamber 61 of the hollow block 60.

Figure 9:
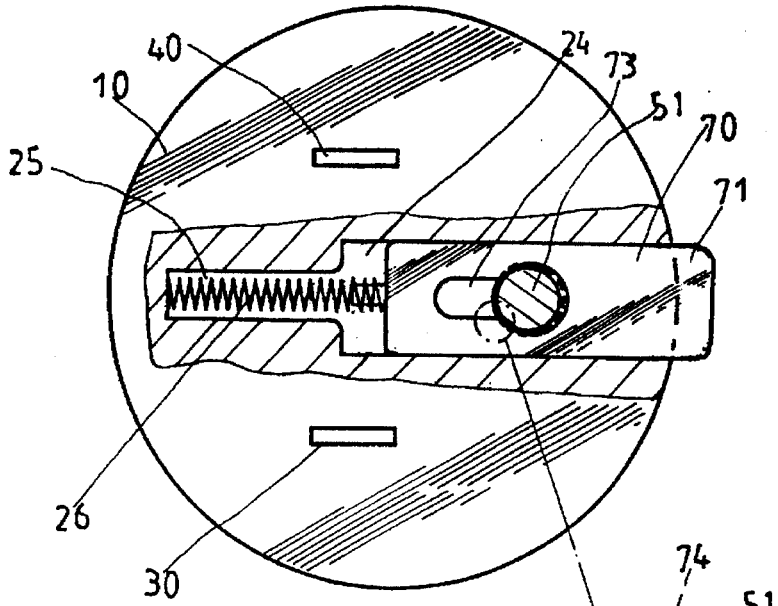
FIG. 9 is a top view of FIG. 8.
Figure 8:
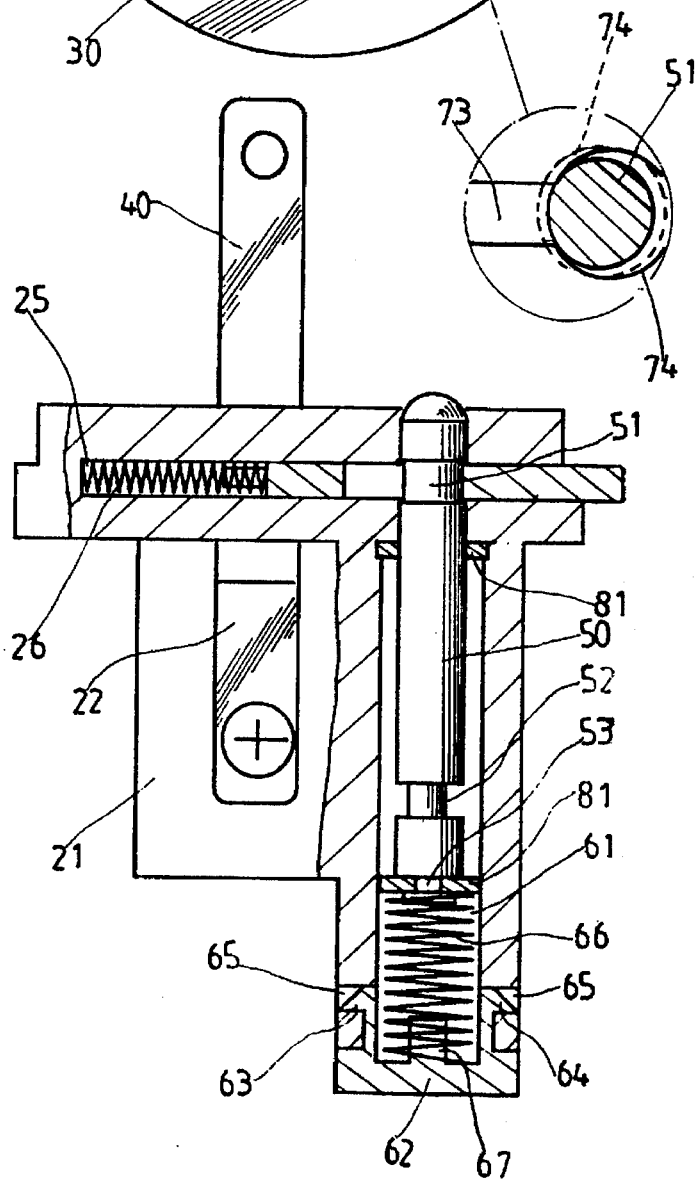
FIG. 8 is another side view in section of the dual-use electric plug shown in FIG. 2, showing the grounding prong retained in the non-working position.

Referring to FIGS. 8 and 9, when the grounding prong 50 is forced into the inside of the receiving chamber 61 to compress the spring 66 as shown in FIG. 8, the press bar 70 is released from hand and forced outwards by the coiled spring 26, causing one end of the oblong hole 73 to engage the first neck 51 of the grounding prong 50 (see FIG. 9), therefore the grounding prong 50 is retained in the non-working position and received inside the receiving chamber 61 of the hollow block 60. When the press bar 70 is depressed again to release the oblong hole 73 from the first neck 51 of the grounding prong 50, the grounding prong 50 is forced out of the vertical through hole 23 of the base 20 by the spring 66 into the working position again.

It is to be understood that the drawings are designed for purposes of illustration only, and are not intended as a definition of the limits and scope of the invention disclosed.

I claim:

1. A dual-use electric plug comprising:

a base having a hollow block perpendicularly disposed at a back side thereof, said hollow block defining a longitudinal receiving chamber, a vertical through hole at a front side thereof in communication with said receiving chamber, and a horizontal side hole intersecting said vertical through hole;

two blades fixedly and perpendicularly fastened to the front side of said base for connection to the hot wire and the neutral wire;

a first spring member mounted within said receiving chamber;

a second spring member mounted within said horizontal side hole;

a grounding prong inserted through the vertical through hole of said base and alternatively moved between a working position outside said vertical through hole and a non-working position inside said receiving chamber, said grounding prong having a first neck end a second neck at different elevations; and a press bar having one end inserted into said horizontal side hole and connected to one end of said second spring member, an opposite end extending out of said horizontal side hole, and a keyhole in the middle for allowing said grounding prong and to pass therethrough, said keyhole consisting of an oblong hole for engagement with one neck of said grounding prong to hold said grounding prong in the working or non-working position, and an expanded circular hole for permitting said grounding prong to pass therethrough.

2. The dual-use electric plug of claim 1 further comprising a bottom cap covering a bottom opening on said hollow chamber, said bottom cap having an upright rod, which holds one end of said first spring member.

3. The dual-use electric plug of claim 1 wherein said horizontal side hole of said base has a reduced inner end, which holds one end of said second spring member; said press bar has a projecting rod at one end, which holds an opposite end of said second spring member.

4. The dual-use electric plug of claim 1 further comprising a grounding contact metal plate fixedly fastened to said hollow block on the outside thereof, having a bent top inserted into a side hole on said base to make contact with said grounding prong.

* * * * *